US009318071B2

(12) United States Patent
Won et al.

(10) Patent No.: US 9,318,071 B2
(45) Date of Patent: Apr. 19, 2016

(54) DISPLAY DEVICE

(71) Applicant: Samsung Display Co., Ltd., Yongin, Gyeonggi-Do (KR)

(72) Inventors: Myung-Ho Won, Seoul (KR); Ri-Na You, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 434 days.

(21) Appl. No.: 13/753,291
(22) Filed: Jan. 29, 2013

(65) Prior Publication Data

US 2014/0104248 A1 Apr. 17, 2014

(30) Foreign Application Priority Data

Oct. 17, 2012 (KR) ..... 10-2012-0115549

(51) Int. Cl.
*G09G 5/00* (2006.01)
*G09G 3/36* (2006.01)

(52) U.S. Cl.
CPC ..... *G09G 5/00* (2013.01); *G09G 3/3677* (2013.01); *G09G 3/3696* (2013.01); *G09G 3/3614* (2013.01); *G09G 2310/0289* (2013.01); *G09G 2320/0233* (2013.01); *G09G 2330/023* (2013.01)

(58) Field of Classification Search
CPC ..... G09G 5/00; G09G 3/3677; G09G 3/3696; G09G 3/3614; G09G 2310/0289; G09G 2320/0233; G09G 2330/023
See application file for complete search history.

(56) References Cited

U.S. PATENT DOCUMENTS 7,420,533 B2 9/2008 Yun
7,443,372 B2 10/2008 Lee et al.
7,502,087 B2 3/2009 Kim et al.
7,745,830 B2 6/2010 Gu et al.
7,817,123 B2 * 10/2010 Do et al. ..... 345/87
7,821,003 B2 10/2010 Na et al.
8,941,577 B2 * 1/2015 Ohara ..... 345/100
2004/0125065 A1 * 7/2004 Park et al. ..... 345/92
2007/0040795 A1 * 2/2007 Lee et al. ..... 345/100
2007/0159438 A1 * 7/2007 Cho ..... G09G 3/3648 345/98
2007/0285370 A1 12/2007 Kim et al.
2007/0296682 A1 * 12/2007 Hwang ..... G09G 3/3677 345/100
2008/0136809 A1 * 6/2008 Lee ..... G09G 3/3677 345/214

(Continued)

FOREIGN PATENT DOCUMENTS

JP 09-236790 9/1997
JP 2011-043791 3/2011
KR 10-2006-0000278 1/2006
KR 10-2007-0072962 7/2007
KR 10-2009-0020405 2/2009
KR 10-2011-0101800 9/2011

*Primary Examiner* — Kumar Patel
*Assistant Examiner* — Sejoon Ahn
(74) *Attorney, Agent, or Firm* — Innovation Counsel LLP

(57) ABSTRACT

A display device includes pixels and includes a gate driver for providing gate signals to the pixels. The display device further includes a level shifter element for providing a boosted clock signal to the gate driver. The display device further includes a controller. The level shifter element includes a first level shifter for providing one of a first gate-on voltage and a gate-off voltage as a first clock signal in response to a gate pulse signal received from the controller. The level shifter element further includes a second level shifter for providing one of a second gate-on voltage and the first clock signal as the boosted clock signal in response to a first control signal received from the controller. The second gate-on voltage is higher than the first gate-on voltage. The gate driver may provide the gate signals in response to the boosted clock signal.

14 Claims, 12 Drawing Sheets

(56) References Cited

U.S. PATENT DOCUMENTS

| | | | | |
|---|---|---|---|---|
| 2008/0211760 | A1* | 9/2008 | Baek et al. | 345/98 |
| 2009/0079715 | A1* | 3/2009 | Kim | 345/204 |
| 2009/0091367 | A1* | 4/2009 | Chiou | 327/333 |
| 2009/0225104 | A1* | 9/2009 | Hu et al. | 345/690 |
| 2010/0085348 | A1* | 4/2010 | Bae et al. | 345/213 |
| 2011/0007059 | A1 | 1/2011 | Do et al. | |
| 2011/0037747 | A1 | 2/2011 | Lee | |
| 2012/0019497 | A1* | 1/2012 | Kim | G09G 3/3677 345/210 |

* cited by examiner

DISPLAY DEVICE

CROSS-REFERENCE TO RELATED APPLICATIONS

This application claims priority to and benefit of Korean Patent Application No. 10-2012-0115549 filed on Oct. 17, 2012 in the Korean Intellectual Property Office, the contents of the prior application are incorporated herein by reference.

BACKGROUND

The present invention is related to a display device that is capable of displaying images.

A display device may include a display panel for displaying images and may include drivers, such as a data driver and a gate driver, for driving the display panel. The display panel may include a plurality of gate lines, a plurality of data lines, and a plurality of pixels. Each of the pixels may include a thin film transistor, a liquid crystal capacitor, and a storage capacitor. The data driver may provide gray voltages to the pixels through the data lines, and the gate driver may provide gate signals to the pixels through the gate lines.

The display device may display images by applying a gate-on voltage to a gate electrode of a thin film transistor connected with a selected gate line and then applying a data voltage corresponding to a display image to a source electrode of the thin film transistor.

In general, a data line may be connected with a plurality of pixels. The data driver may provide various data voltages through the data line to the plurality of pixels for displaying an image, which is a combination of images displayed by the pixels. Typically, luminance of an image to be displayed by a pixel may vary according to the relationship between a previous data voltage and a current data voltage received by the pixel. Irregular luminance may cause undesirable quality of the displayed image.

SUMMARY

One or more embodiments of the present invention may be related to a display device that may include a display panel. The display panel may include a plurality of pixels connected to a plurality of data lines and a plurality of gate lines. The display device may further include a gate driver configured to provide gate signals through the plurality of gate lines to the plurality of pixels. The display device may further include a data driver configured to provide data signals through the plurality of data lines to the plurality of pixels. The display device may further include a level shifter element configured to provide a first boosted gate clock signal to the gate driver. The gate driver may provide one or more of the gate signals in response to the first boosted gate clock signal. The display device may further include a timing controller configured to provide a plurality of control signals for controlling the level shifter element, the gate driver, and the data driver.

In one or more embodiments, the level shifter element may include a first level shifter configured to provide one of a first gate-on voltage and a gate-off voltage as a first gate clock signal in response to a gate pulse signal received from the timing controller. The level shifter element may further include a second level shifter configured to provide one of a second gate-on voltage and the first gate clock signal as the first boosted gate clock signal in response to a first control signal received from the timing controller. The second gate-on voltage may be higher than the first gate-on voltage.

In one or more embodiments, the first level shifter may include a first switching circuit configured to output one of the first gate-on voltage and the gate off voltage as the first gate clock signal in response to the gate pulse signal.

In one or more embodiments, the level shifter element may be further configured to provide a second boosted gate clock signal to the gate driver. the first level shifter may further include a second switching circuit configured to output one of the first gate-on voltage and the gate off voltage as a second gate clock signal in response to the gate pulse signal.

In one or more embodiments, the second level shifter may be configured to output one of the second gate-on voltage and the second gate clock signal as the second boosted gate clock signal in response to a second control signal received from the timing controller.

In one or more embodiments, the second level shifter may be configured to output the first boosted gate pulse signal, the first boosted gate pulse signal including a first portion and a second portion, the first portion having a rising edge that occurs in response to the first gate clock signal, the second portion having a rising edge that occurs in response to the first control signal, a magnitude of the first portion being equal to the first gate-on voltage, a magnitude of the second portion being equal to the second gate-on voltage.

In one or more embodiments, the second level shifter may include a first clock generator configured to periodically and alternately output the first gate clock signal and the second gate-on voltage as the first boosted gate clock signal in response to the first control signal.

In one or more embodiments, the second level shifter may further include a second clock generator configured to periodically and alternately output a second gate clock signal and the second gate-on voltage as a second boosted gate clock signal in turn in response to a second control signal received from the timing controller.

In one or more embodiments, the first clock generator may include a first switching unit configured to output one of the gate-off voltage and the second gate-on voltage to a first node in response to the first control signal. The first clock generator may further include a first resistor electrically connected to the first node and subjected to the gate-off voltage. The first clock generator may further include a second switching unit configured to output one of the second gate-on voltage and the first gate clock signal to a second node as the first boosted gate clock signal in response to a signal provided from the first node. The first clock generator may further include a second resistor electrically connected to the second node and subjected to the gate-off voltage.

In one or more embodiments, the first switching unit may include a third resistor subjected to the second gate-on voltage. The first switching unit may further include a fourth resistor electrically connected to the third resistor at a connection point. The first switching unit may further include a first transistor electrically connected to the fourth resistor, subjected to the gate-off voltage, and having a gate terminal configured to receive the first control signal. The first switching unit may further include a second transistor subjected to the second gate-on voltage, electrically connected to the first node, and having a gate terminal electrically connected to the connection point. In one or more embodiments, the first transistor may include an n-type semiconductor (e.g., an n-type metal oxide semiconductor or NMOS), and the second transistor may include a p-type semiconductor (e.g., a p-type metal oxide semiconductor or PMOS).

In one or more embodiments, the second switching unit may include a first transistor subjected to the second gate-on voltage, electrically connected to the second node, and having a gate terminal electrically connected to the first node. The second switching unit may further include a second transistor electrically connected to the second node, configured to receive the first gate clock signal, and having a gate terminal electrically connected to the first node. In one or more embodiments, the first transistor may include an n-type semiconductor, and the second transistor may include a p-type semiconductor.

In one or more embodiments, the timing controller may be configured to provide the gate pulse signal at a first level for a time period. The time period may include a first portion and a second portion. The timing controller may be configured to provide the first control signal at the first level for the second portion. In one or more embodiments, the second portion may follow the first portion.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1:
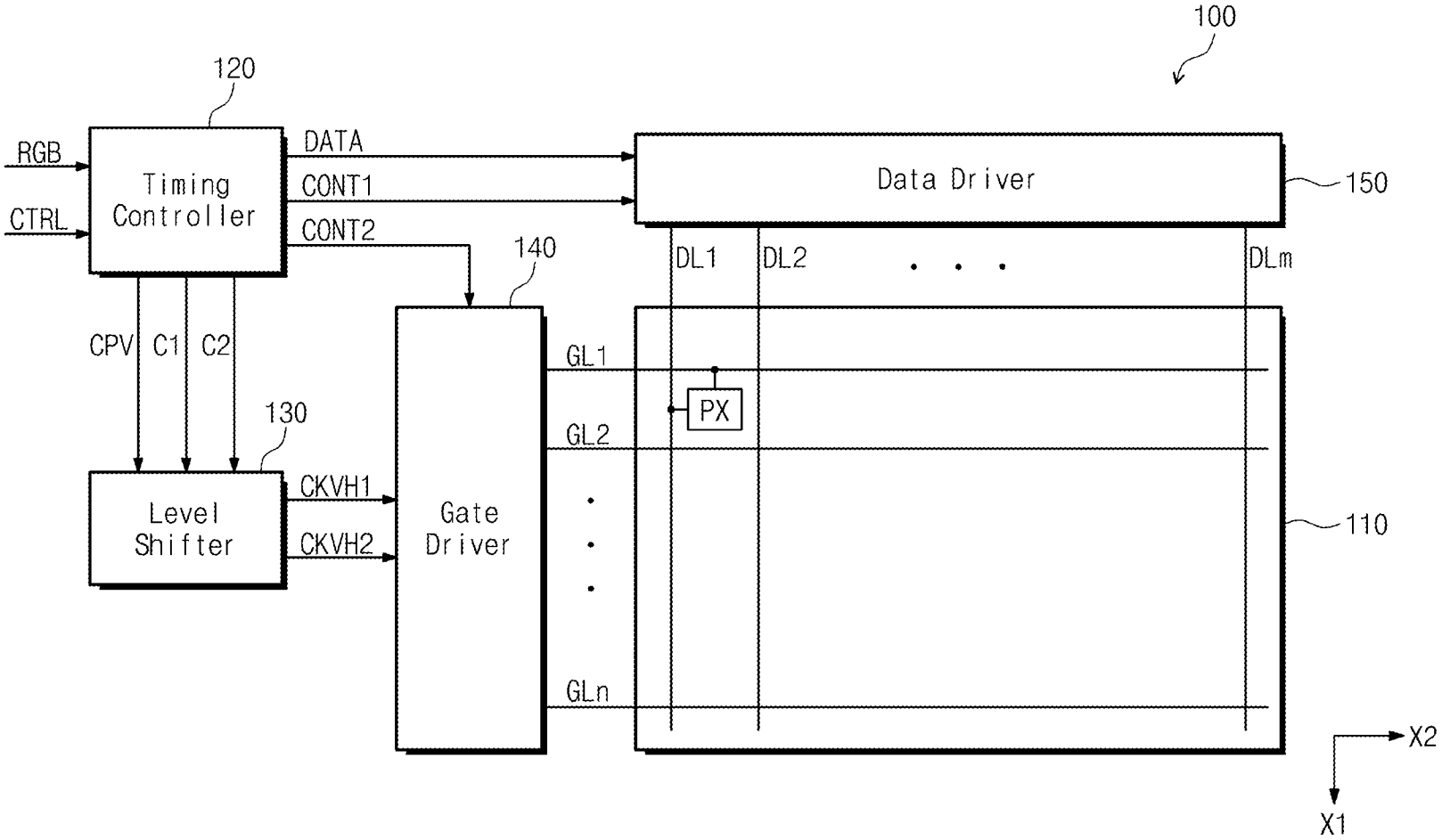
FIG. 1 is a block diagram schematically illustrating a display device according to one or more embodiments of the invention.

Embodiments will be described in detail with reference to the accompanying drawings. The invention, however, may be embodied in various different forms, and should not be construed as being limited only to the illustrated embodiments. Rather, these embodiments are provided as examples so that this disclosure will be thorough and complete, and will fully convey the concept of the invention to those skilled in the art. Known processes, elements, and techniques may not be described with respect to some of the embodiments of the invention. Like reference numerals may denote like elements in the attached drawings and written description, and descriptions may not be repeated. In the drawings, the sizes and relative sizes of layers and regions may be exaggerated for clarity.

Various embodiments are described herein below, including methods and techniques. Embodiments of the invention might also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the invention may also cover apparatuses for practicing embodiments of the invention. Such apparatus may include circuits, dedicated and/or programmable, to carry out operations pertaining to embodiments of the invention. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments of the invention.

Although the terms first, second, third etc. may be used herein to describe various signals, elements, components, regions, layers, and/or sections, these signals, elements, components, regions, layers, and/or sections should not be limited by these terms. These terms may be used to distinguish one signal, element, component, region, layer, or section from another signal, region, layer or section. Thus, a first signal, element, component, region, layer, or section discussed below may be termed a second signal, element, component, region, layer, or section without departing from the teachings of the present invention. The description of an element as a "first" element may not require or imply the presence of a second element or other elements. The terms first, second, third, etc. may also be used herein to differentiate different categories of elements. For conciseness, the terms first, second, etc. may represent first-type (or first-category), second-type (or second-category), etc., respectively.

In the specification, being connected to a voltage may mean being connected to a source of the voltage, and being connected between an element and a voltage may mean being connected between the element and a source of the voltage, for conciseness.

FIG. 1 is a block diagram schematically illustrating a display device 100 according to one or more embodiments of the invention.

Referring to FIG. 1, the display device 100 may include a display panel 110, a timing controller 120, a level shifter element 130, a gate driver 140, and a data driver 150.

The display panel 110 may include a plurality of data lines DL1 to DLm extending in a first direction X1, a plurality of gate lines GL1 to GLn extending in a second direction X2 and crossing the plurality of data lines DL1 to DLm, and a plurality of pixels PX arranged at intersections of the data lines DL1 to DLm and the gate lines GL1 to GLn. The data lines DL1 to DLm and the gate lines GL1 to GLn may be electrically insulated from one another.

Although not explicitly shown in FIG. 1, each pixel PX may include a switching transistor connected with a corresponding data line and a corresponding gate line, a liquid crystal capacitor connected with the switching transistor, and a storage capacitor.

The timing controller 120 may receive, from an external device, an image signal RGB and control signals CTRL for controlling a display of the image signal RGB. The control signals CTRL may include a vertical synchronization signal Vsync, a horizontal synchronization signal Hsync, a main clock signal MCLK, a data enable signal DE, and so on. Based on the control signal CTRL, the timing controller 120 may provide a data signal and a first driving control signal CONT1 to the data driver 150 and may provide a second control signal CONT2 to the gate driver 140. The data signal may be generated by processing the image signal RGB to be suitable for an operating condition of the display panel 110. The first driving control signal CONT1 may include a horizontal synchronization start signal STH, a clock signal HCLK, and a line latch signal TP. The second driving control signal CONT2 may include a vertical synchronization start signal STV1 and an output enable signal OE. The timing controller 120 may provide the level shifter element 130 with a gate pulse signal CPV, a first control signal C1, and a second control signal C2.

The data driver 150 may provide grayscale voltages to the pixels PX through the data lines DL1 to DLm in response to the data signal and the first driving control signal CONT1 from the timing controller 120.

The level shifter element 130 may generate a first boosted gate clock signal CKVH1 and a second boosted gate clock signal CKVH2 in response to the gate pulse signal CPV and the control signals C1 and C2 received from the timing controller 120.

The gate driver 140 may provide gate voltage signals to the pixels PX through the gate lines GL1 to GLn in response to the second driving control signal CONT2 received from the timing controller 120 and the boosted gate clock signals CKVH1 and CKVH2 received from the level shifter element 130. The gate driver 140 may include a gate driving integrated circuit. In one or more embodiments, the gate driving integrated circuit may include one or more of an amorphous silicon gate (ASG) that includes an amorphous Silicon Thin Film Transistor (or a-Si TFT), an oxide semiconductor, a crystalline semiconductor, a polycrystalline semiconductor, and so on FIG. 2 is a diagram illustrating a configuration of the gate driver 140 and an arrangement of the pixels PX in the display panel 110 of FIG. 1 according to one or more embodiments of the invention.

Figure 2:
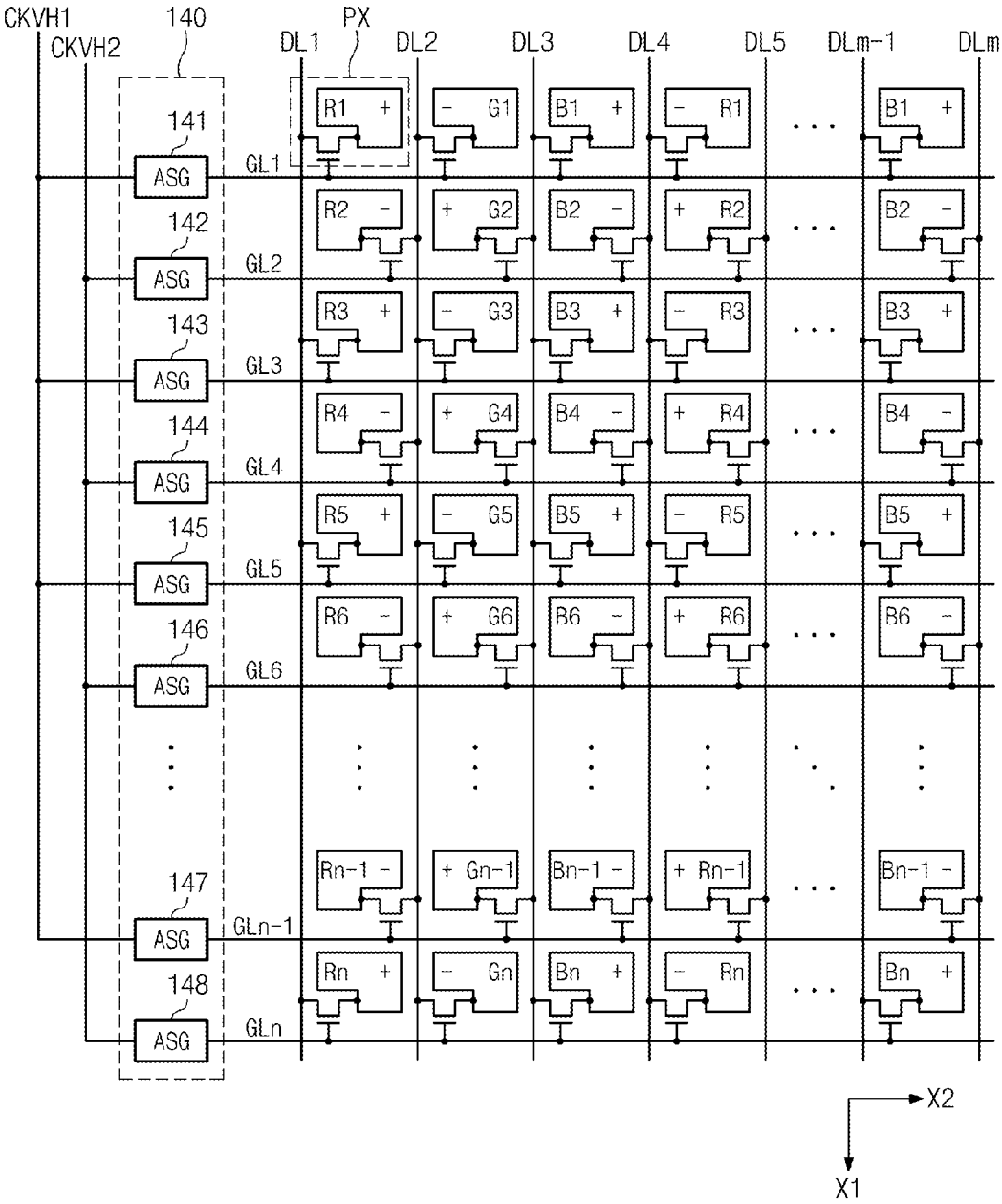
FIG. 2 is a diagram illustrating a configuration of a gate driver and an arrangement of pixels in a display panel of FIG. 1 according to one or more embodiments of the invention.

Referring to FIG. 2, the gate driver 140 may include amorphous silicon gate (hereinafter, referred to as 'ASG') circuits 141, 142, 143, 144, 145, 146, . . . 147, and 148 respectively corresponding to and connected to gate lines GL1 to GLn. A first boosted gate clock signal CKVH1 from a level shifter element 130 may be provided to the ASG circuits 141, 143, . . . , and 147, which are connected to odd-numbered gate lines GL1, GL3, GL5, . . . , and GLn−1, respectively. A second boosted gate clock signal CKVH2 may be provided to the ASG circuits 142, 144, . . . , and 148, which are connected to even-numbered gate lines GL2, GL4, GL6, . . . , and GLn, respectively. The ASG circuits 141, 143, . . . , and 147 may provide signals to corresponding gate lines GL1, GL3, . . . , and GLn−1 in response to the first boosted gate clock signal CKVH1. The ASG circuits 142, 144, . . . , and 148 may provide signals to corresponding gate lines GL2, GL4, . . . , and GLn in response to the second boosted gate clock signal CKVH2. In one or more embodiments, the gate driver 140 may include elements that are alternative to or additionally to the ASG circuits 141 to 148, etc. for performing the functions of the ASG circuits 141 to 148, etc.

In the display panel 110, a pixel PX may include a switching transistor and may include one of a red filter, a green filter, and a blue filter. A pixel including a red filter may be referred to as a red pixel, a pixel including a green filter may be referred to as a green pixel, and a pixel including a blue filter may be referred to as a blue pixel.

Each of the switching transistors may be connected to a corresponding data line and a corresponding gate line. The pixels PX may be arranged in rows according to the extending direction of the gate lines, that is, the second direction X2, and pixels having the same color may be arranged in a column according to an extending direction of a data line, that is, a first direction X1. For example, a plurality of red pixels R1 to Rn may be disposed between the data lines DL1 and DL2, a plurality of green pixels G1 to Gn may be disposed between the data lines DL2 and DL3, and a plurality of blue pixels B1 to Bn may be disposed between the data lines DL3 and DL4. In one or more embodiments, red, green, and blue pixels R, G, and B may be sequentially and repeatedly disposed in the second direction X2, which is the extending direction of the gate lines. The repeated order of the pixels in the second direction X2 may include one or more of (R, G, B), (R, B, G), (G, B, R), (G, R, B), (B, R, G), (B, G, R), and so on.

Referring to FIG. 2, in one or more embodiments, switching transistors of pixels connected to odd-numbered gate lines GL1, GL3, GL5, . . . , and GLn−1 may be connected to a data line immediately adjacent to left sides of the pixels, and switching transistors of pixels connected to even-numbered gate lines GL2, GL4, GL6, . . . , and GLn may be connected to a data line immediately adjacent to right sides of the pixels. For example, switching transistors of pixels connected to a gate line GL1 may be connected to data lines that are immediately adjacent to left sides of the pixels, and switching transistors of pixels connected to a gate line GL2 may be connected to data lines that are immediately adjacent to right sides of the pixels.

Grayscale voltages may be provided to the data lines DL1 to DLm in a column inversion manner. According to the column inversion manner, polarities of grayscale voltages provided to immediately adjacent data lines may be complementary based on a common voltage VCOM.

With the above-described connection structure between pixels and data lines and with grayscale voltages being provided to data lines in the column inversion manner, as the pixels may be driven in a dot inversion manner. That is, grayscale voltages provided to immediately adjacent pixels may have complementary polarities. As a result, luminance differences caused by kick-back voltages may be inconspicuous to a viewer. Thus, vertical flicker may be minimized.

Figure 3:
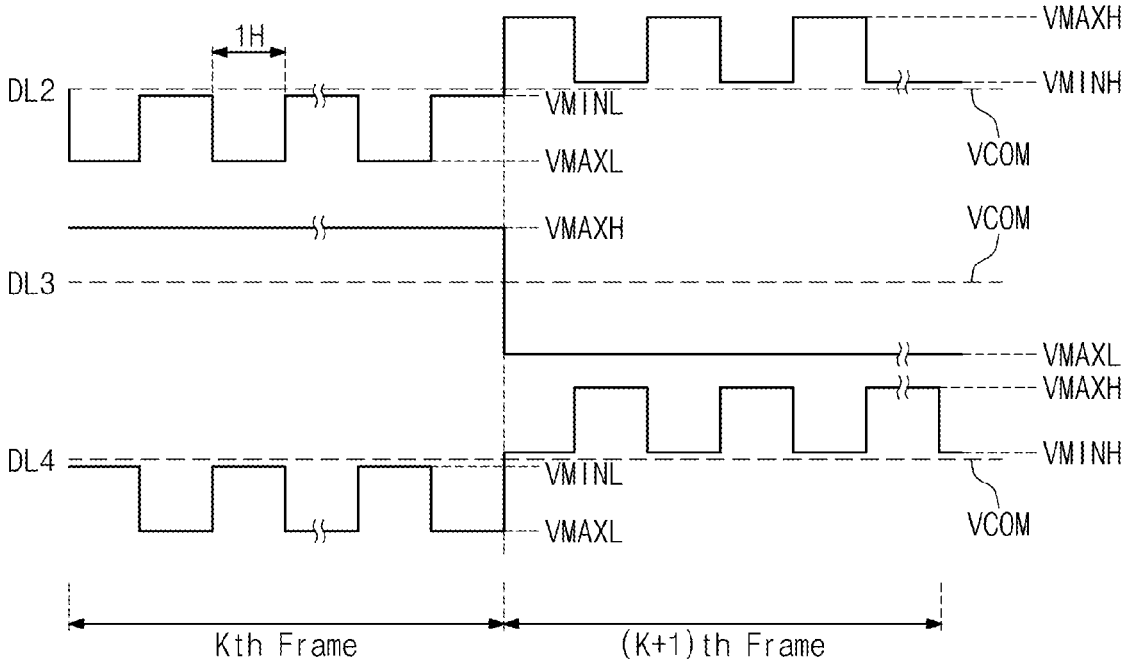
FIG. 3 is a timing diagram illustrating an operation of the display panel of FIG. 1 and FIG. 2 according to one or more embodiments of the invention.

FIG. 3 is a timing diagram illustrating an operation of the display panel 110 of FIG. 1 and FIG. 2 according to one or more embodiments of the invention.

An example in which a minimum grayscale voltage VMINL is applied to red pixels and in which a maximum grayscale voltage VMAXL is applied to green pixels and blue pixels will be described with reference to FIGS. 2 and 3.

Referring to FIGS. 2 and 3, in one or more embodiments, the maximum grayscale voltage VMAXL is applied to the green pixels G1 to Gn and the blue pixels B1 to Bn, and the maximum grayscale voltage VMAXL and the minimum grayscale voltage VMINL may be alternately applied to a data line DL2, which is connected to red pixels R2, R4, R6, etc. and green pixels G1, G3, G5, etc., every horizontal period 1H in each frame. The polarity of the grayscale voltages applied in the (K+1)th frame may be opposite to (and/or complementary to) the polarity of the grayscale voltages applied in the Kth frame, which immediately precedes the (K+1)th frame.

For one frame (or for each frame), the maximum grayscale voltage VMAXH may be applied to a data line DL3, which is connected to green pixels G2, G4, G6, etc. and blue pixels B1, BG3, BG5, etc.

The minimum grayscale voltage VMINL and the maximum grayscale voltage VMAXL may be alternately applied to a data line DL4, which is connected to blue pixels B2, B4, B6, etc. and red pixels R1, R3, R5, etc., every horizontal period 1H.

Therefore, luminance of pixels connected to the data line DL3 and maintaining the same voltage level throughout one frame may be brighter than luminance of pixels connected to one of the data lines DL2 and DL4 and receiving grayscale voltages that vary every horizontal period 1H.

That is, luminance of pixels B1, G2, B3, G4, B5, G6, etc., which are connected to the data line DL3, may be higher than that of green pixels G1, G3, G5, etc., which are connected to the data line DL2, and that of blue pixels B2, B4, B6, etc., which are connected to the data line DL4. In one or more embodiments, for minimizing luminance irregularity, a sufficiently increased gate-on voltage may be applied to a gate electrode of a switching transistor in a pixel PX.

Figure 4:
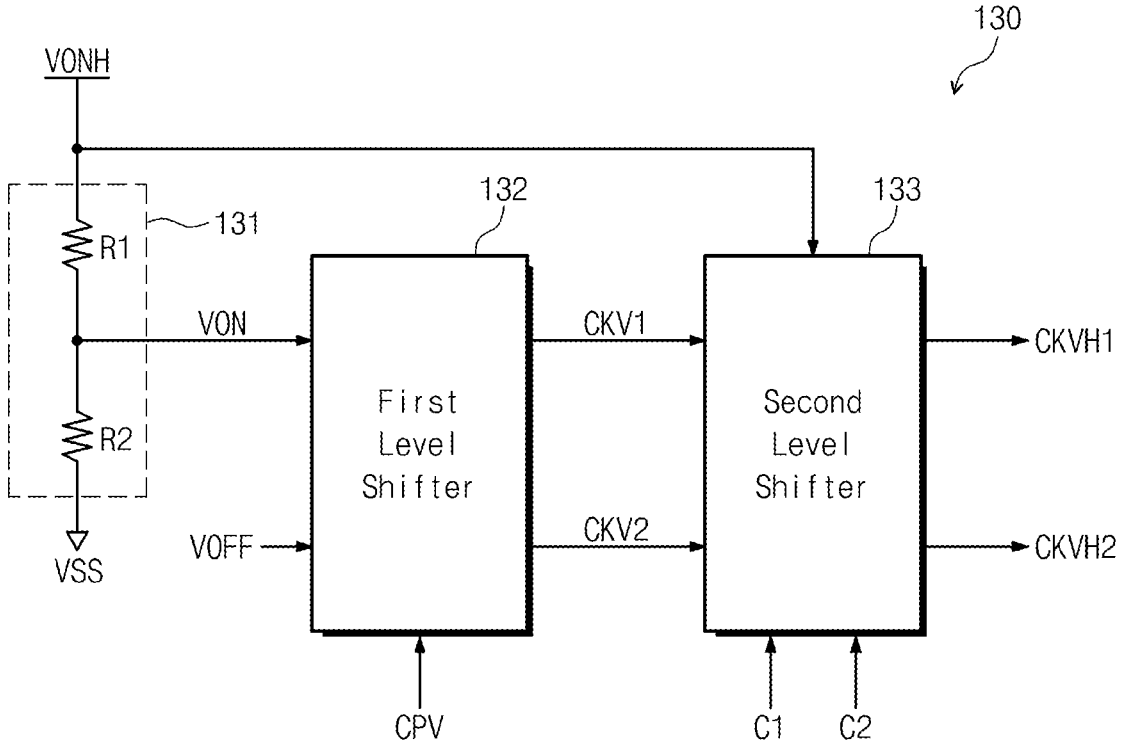
FIG. 4 is a block diagram schematically illustrating a level shifter element of FIG. 1 according to one or more embodiments of the invention.

FIG. 4 is a block diagram schematically illustrating the level shifter element 130 of FIG. 1 according to one or more embodiments of the invention.

Referring to FIG. 4, the level shifter element 130 may include a voltage divider 131, a first level shifter 132, and a second level shifter 133. The voltage divider 131 may include resistors R1 and R2. A voltage on a tap of the voltage divider 131 may be output as a first gate-on voltage VON. The resistors R1 and R2 may be electrically connected in series between a second gate-on voltage VONH and a ground voltage VSS. The second gate-on voltage VONH may be higher than the first gate-on voltage VON. In one or more embodiments, the first gate-on voltage VON may be 28V, and the second gate-on voltage VONH may be 35V.

The first level shifter 132 may receive the first gate-on voltage VON and a gate-off voltage VOFF, and may output a first gate clock signal CKV1 and a second gate clock signal CKV2 in response to a gate pulse signal CPV received from the timing controller 120 of FIG. 1.

The second level shifter 133 may output one of the second gate-on voltage VONH and the first gate clock signal CKV1 as a first boosted gate clock signal CKVH1 in response to a first control signal C1 received from the timing controller 120. Additionally or alternatively, the second level shifter 133 may output one of the second gate-on voltage VONH and the second gate clock signal CKV2 as a second boosted gate clock signal CKVH2 in response to a second control signal C2 received from the timing controller 120.

Figure 5:
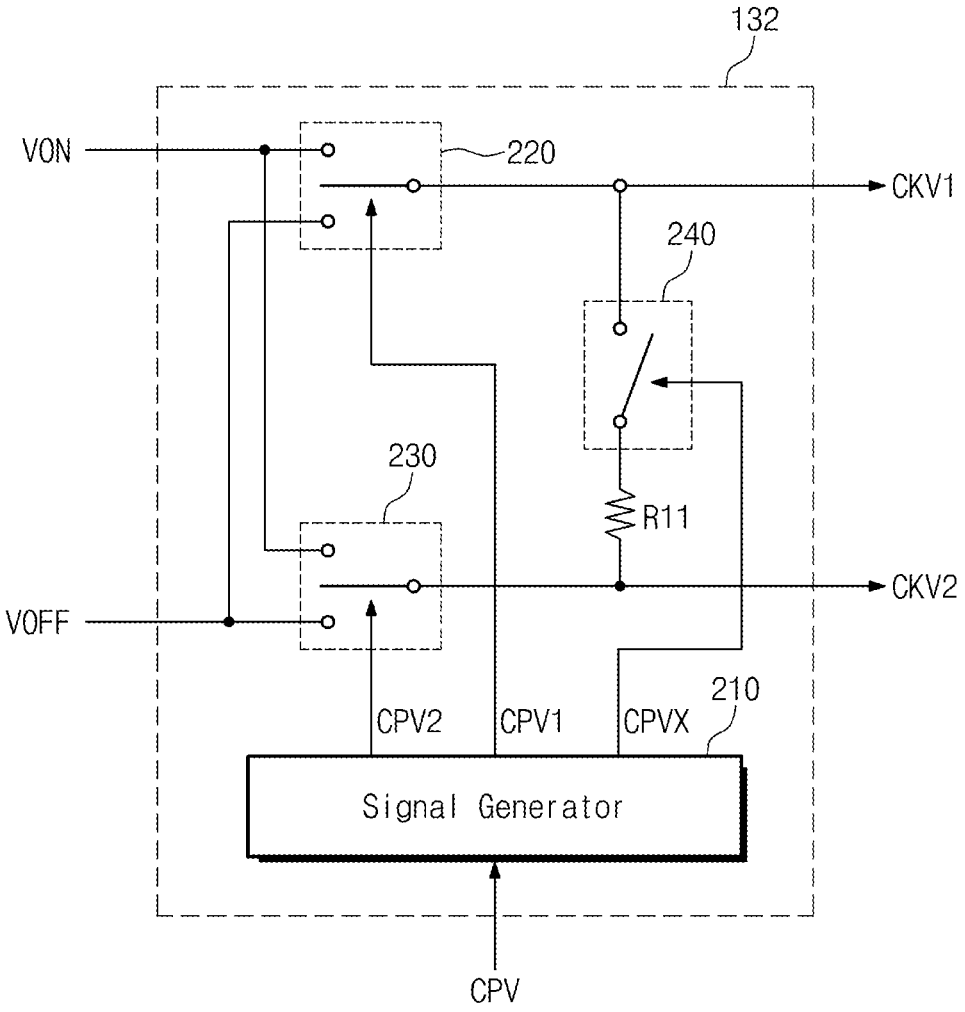
FIG. 5 is a circuit diagram schematically illustrating a first level shifter of FIG. 4 according to one or more embodiments of the invention.

FIG. 5 is a circuit diagram schematically illustrating the first level shifter 132 of FIG. 4 according to one or more embodiments of the invention.

Referring to FIG. 5, the first level shifter 132 may include a signal generator 210, switching circuits 220, 230, and 240, and a resistor R11. The signal generator 210 may generate a first gate pulse signal CPV1, a second gate pulse signal CPV2, and a charge share signal CPVX in response to a gate pulse signal CPV received from the timing controller 120 of FIG. 1.

The first switching circuit 220 may output one of a first gate-on voltage VON and a gate-off voltage as a first gate clock signal CKV1 in response to the first gate pulse signal CPV1. The second switching circuit 230 may output one of the first gate-on voltage VON and the gate-off voltage as a second gate clock signal CKV2 in response to the second gate pulse signal CPV2. The switch circuit 240 and the resistor R11 may be electrically connected in series between an output node of the first gate clock signal CKV1 and an output node of the second gate clock signal CKV2. The switching circuit 240 may electrically connect the output node of the first gate clock signal CKV1 and the output node of the second gate clock signal CKV2 in response to the charge share signal CPVX.

Figure 6:
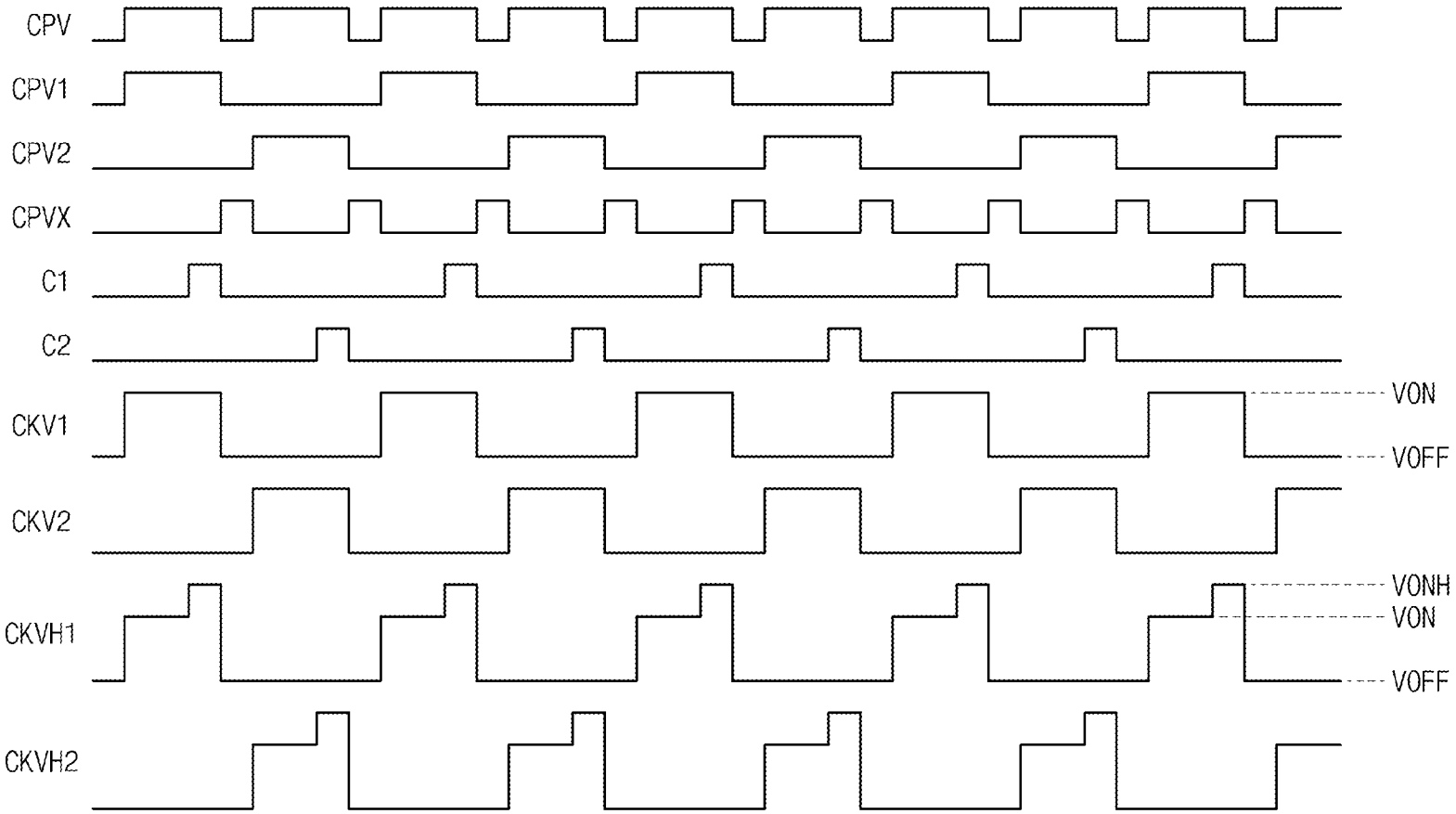
FIG. 6 is a timing diagram illustrating signals generated from the level shifter element of FIG. 1 and FIG. 4 according to one or more embodiments of the invention.

FIG. 6 is a timing diagram illustrating signals generated from the level shifter 130 of FIG. 1 and FIG. 4 according to one or more embodiments of the invention.

Referring to FIGS. 5 and 6, a first gate pulse signal CPV1 may be periodically activated in synchronization with a gate pulse signal CPV every two periods of the gate pulse signal CPV. A second gate pulse signal CPV2 may be periodically activated in synchronization with the gate pulse signal CPV every two periods of the gate pulse signal CPV. The gate pulse signals CPV1 and CPV2 may be activated to a high level alternately. A charge share signal CPVX may be activated to a high level while both the gate pulse signals CPV1 and CPV2 are at a low level.

The switching circuit 220 may output a first gate-on voltage VON as a first gate clock signal CKV1 during a high level of the first gate pulse signal CPV1. The switching circuit 220 may output a gate-off voltage VOFF as the first gate clock signal CKV1 during a low level of the first gate pulse signal CPV1.

The switching circuit 230 may output the first gate-on voltage VON as a second gate clock signal CKV2 during a high level of the second gate pulse signal CPV2. The switching circuit 230 may output the gate-off voltage VOFF as the second gate clock signal CKV2 during a low level of the second gate pulse signal CPV2.

Figure 7:
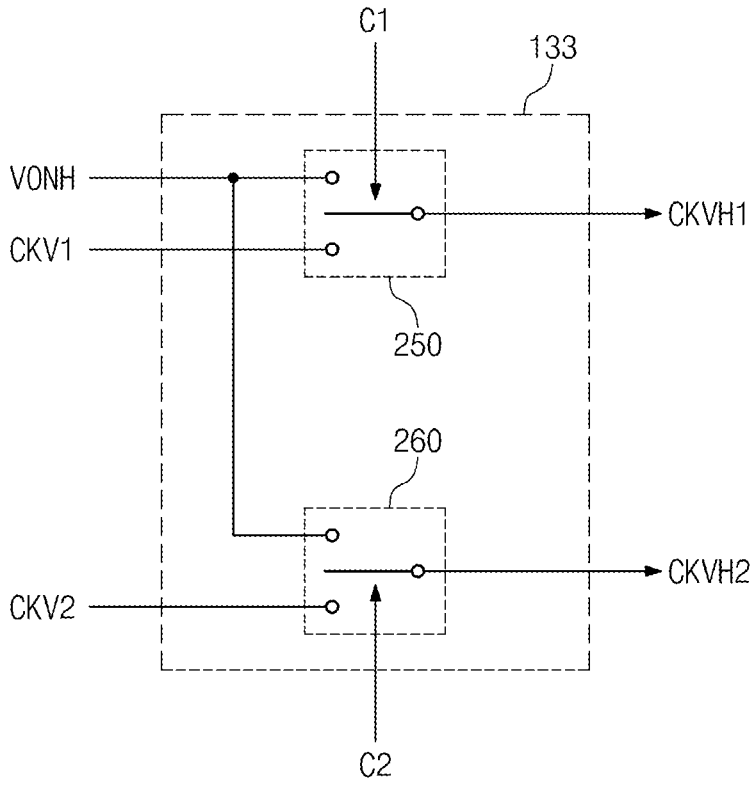
FIG. 7 is a circuit diagram illustrating a second level shifter of FIG. 4 according to one or more embodiments of the invention.

FIG. 7 is a circuit diagram illustrating the second level shifter 133 of FIG. 4 according to one or more embodiments of the invention.

Referring to FIG. 7, the second level shifter 133 may include switching circuits 250 and 260. The switching circuit 250 may output one of a second gate-on voltage VONH and a first gate clock signal CKV1 (which is received from a first level shifter 132 of FIG. 5 and may be equal to the first gate-on voltage VON) as a first boosted gate clock signal CKVH1 in response to a first control signal C1 received from the timing controller 120 of FIG. 1.

The switching circuit 260 may output one of the second gate-on voltage VONH and a second gate clock signal CKV2 (which is received from the first level shifter 132 and may be equal to the first gate-on voltage VON) as a second boosted gate clock signal CKVH2 in response to a second control signal C2 received from the timing controller 120.

Referring to FIGS. 5 and 7, the switching circuit 250 may output the first gate clock signal CKV1 (received from the first level shifter 132 and equal to the first gate-on voltage VON) as the first boosted gate clock signal CKVH1 during a low-level period of the first clock signal C1 (when the first clock signal C1 is at a low level). The switching circuit 250 may output the second gate-on voltage VONH as the first boosted gate clock signal CKVH1 during a high-level period of the first clock signal C1 (when the first clock signal C1 is at a high level).

The switching circuit 260 may output the second gate clock signal CKV2 (received from the first level shifter 132 and equal to the first gate-on voltage VON) as the second boosted gate clock signal CKVH2 during a low-level period of the second clock signal C2 (when the second clock signal C2 is at a low level). The switching circuit 260 may output the second gate-on voltage VONH as the second boosted gate clock signal CKVH2 during a high-level period of the second clock signal C2 (when the second clock signal C2 is at a high level).

As described above, the second gate-on voltage VONH may be higher in level than the first gate-on voltage VON. Therefore, the first boosted gate clock signal CKVH1 (provided by a second level shifter 133) may have a portion that is equal to the second gate-on voltage VONH and is higher than a first gate-on voltage VON. A charge rate of each pixel may be maximized by applying the second gate-on voltage VONH to a gate electrode of a switching transistor of each pixel PX. Thus, luminance irregularity of the display panel 110 may be compensated.

Figure 8:
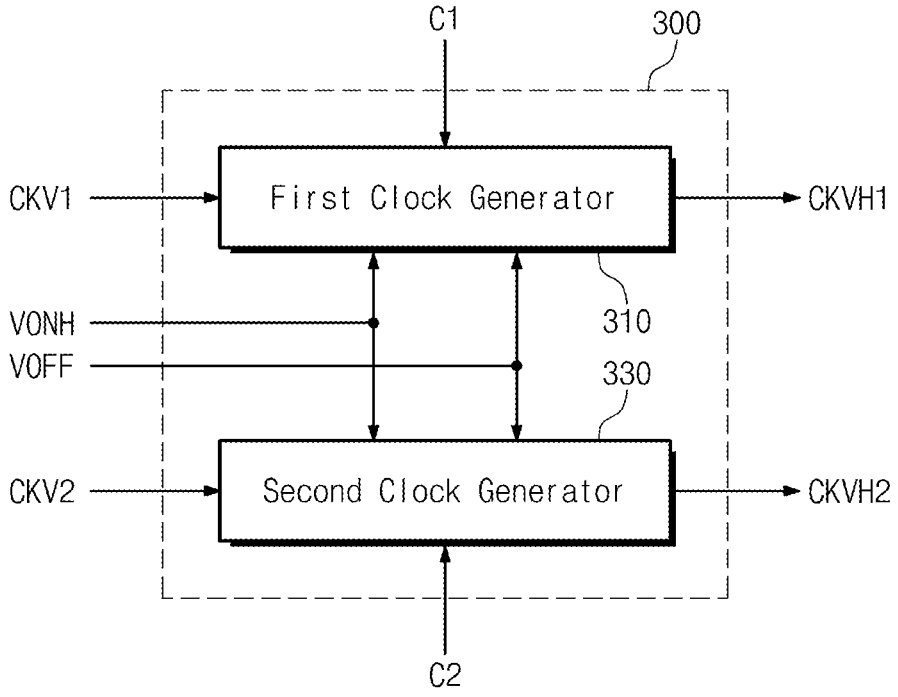
FIG. 8 is a block diagram schematically illustrating the second level shifter of FIG. 4 according to one or more embodiments of the invention.

FIG. 8 is a block diagram schematically illustrating a second level shifter 300, which may be alternative to or additional to the second level shifter 133 of FIG. 4) according to one or more embodiments of the invention.

Referring to FIG. 8, the second level shifter 300 may include a first clock generator 310 and a second clock generator 330. The first clock generator 310 may receive a first gate clock signal CKV1, a second gate-on voltage VONH, and a gate-off voltage VOFF, and may generate a first boosted gate clock signal CKVH1 in response to a first control signal C1 received from the timing controller 120 of FIG. 1. The second clock generator 330 may receive a second gate clock signal CKV2, the second gate-on voltage VONH, and the gate-off voltage VOFF, and may generate a second boosted gate clock signal CKVH2 in response to a second control signal C2 received from the timing controller 120.

Figure 9:
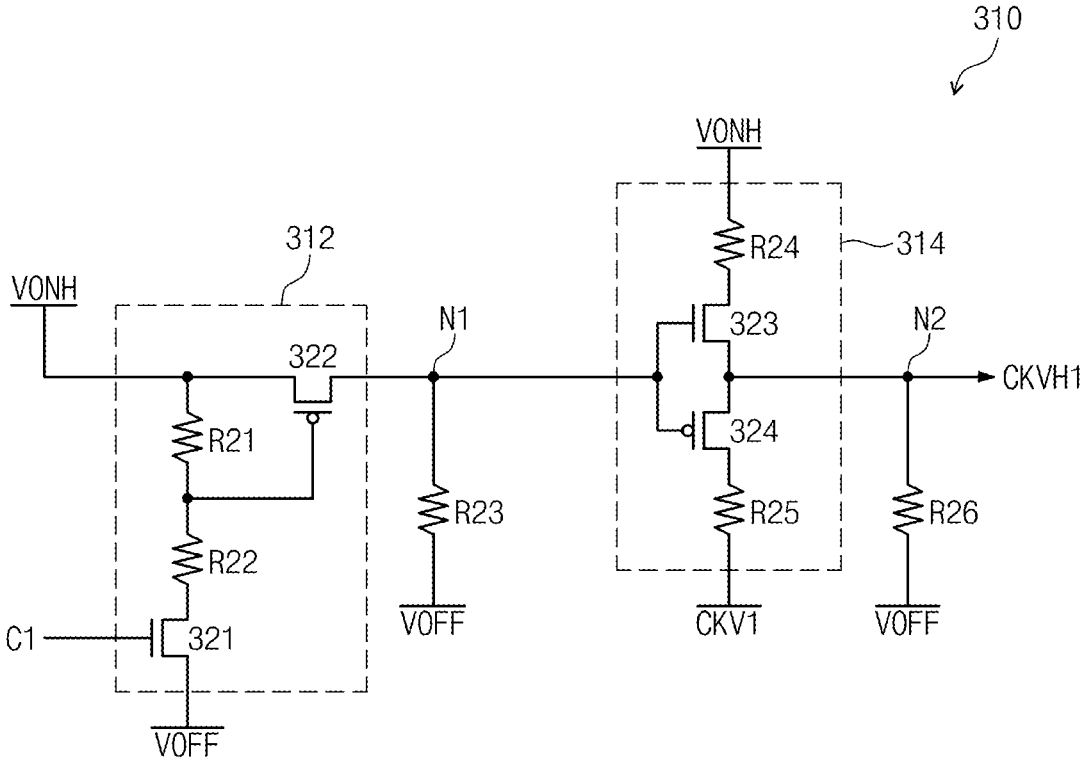
FIG. 9 is a circuit diagram schematically illustrating a first clock generator of FIG. 8 according to one or more embodiments of the invention.

FIG. 9 is a circuit diagram schematically illustrating the first clock generator 310 of FIG. 8 according to one or more embodiments of the invention.

Referring to FIG. 9, the first clock generator 310 may include a first switching unit 312, a second switching unit 314, and resistors R23 and R26.

The first switching unit 312 may include resistors R21 and R22 and transistors 321 and 322. The resistors R21 and R22 and the transistor 321 may be electrically connected in series between the second gate-on voltage VONH (also illustrated in FIG. 8) and the gate-off voltage VOFF (also illustrated in FIG. 8). The transistor 321 may be an NMOS transistor. A gate terminal of the transistor 321 may be connected to receive the first control signal C1 (also illustrated in FIG. 8) from the timing controller 120 of FIG. 1. The transistor 322 may be electrically connected between the second gate-on voltage VONH and a first node N1 that is electrically connected between the first switching unit 312 and the second switching unit 314. The transistor 322 may have a gate terminal electrically connected to a connection node electrically connected between the resistors R21 and R22. The transistor 322 may be a PMOS transistor. The resistor R23 may be electrically connected between the first node N1 and the gate-off voltage VOFF and may be subjected to the gate-off voltage VOFF.

The second switching unit 314 may include resistors R24 and R25 and transistors 323 and 324. The resistor R24, the transistors 323 and 324, and the resistor R25 may be electrically connected in series between the second gate-on voltage VONH and the first gate clock signal CKV1 (also illustrated in FIG. 8). The transistor 323 may be an NMOS transistor, and the transistor 324 may be a PMOS transistor. Gate terminals of the transistors 323 and 324 may be electrically connected to the first node N1. The resistor R26 may be electrically connected between a second node N2 (which is equivalent to or is connected to a connection node that is electrically connected between the transistors 323 and 324) and the gate-off voltage VOFF and may be subjected to the gate-off voltage VOFF. A signal provided through and/or provided from the second node N2 may be the first boosted gate-on voltage CKVH1 (also illustrated in FIG. 8).

When the first control signal C1 is at a low level, the transistors 321 and 322 in the first switching unit 312 may be turned off. As a result, a signal provided from the first node N1 to the second switching unit 314 may have the gate-off voltage VOFF.

When a signal provided from the first node N1 to the second switching unit 314 has the gate-off voltage VOFF, the transistor 323 in the second switching unit 314 may be turned off, while the transistor 324 in the second switching unit 324 may be turned on. As a result, the first gate clock signal CKV1 may be output as the first boosted gate clock signal CKVH1 provided through the resistor R25, the transistor 324, and the second node N2.

When the first control signal C1 is at a high level, the transistor 321 in the first switching unit 312 may be turned on. As a result, a voltage level of a connection node of the resistors R21 and R22 may be lowered to a level of the gate-off voltage VOFF, and the transistor 322 may be turned on. Thus, a signal provided from the first node N1 to the second switching unit 314 may have the second gate-on voltage VONH.

When a signal provided from the first node N1 to the second switching unit 314 has the second gate-on voltage VONH, the transistor 323 in the second switching unit 314 may be turned on, while the transistor 324 in the second switching unit 314 may be turned off. As a result, the first boosted gate clock signal CKVH1 provided from the second node N2 may rise up to a level of the second gate-on voltage VONH.

Figure 10:
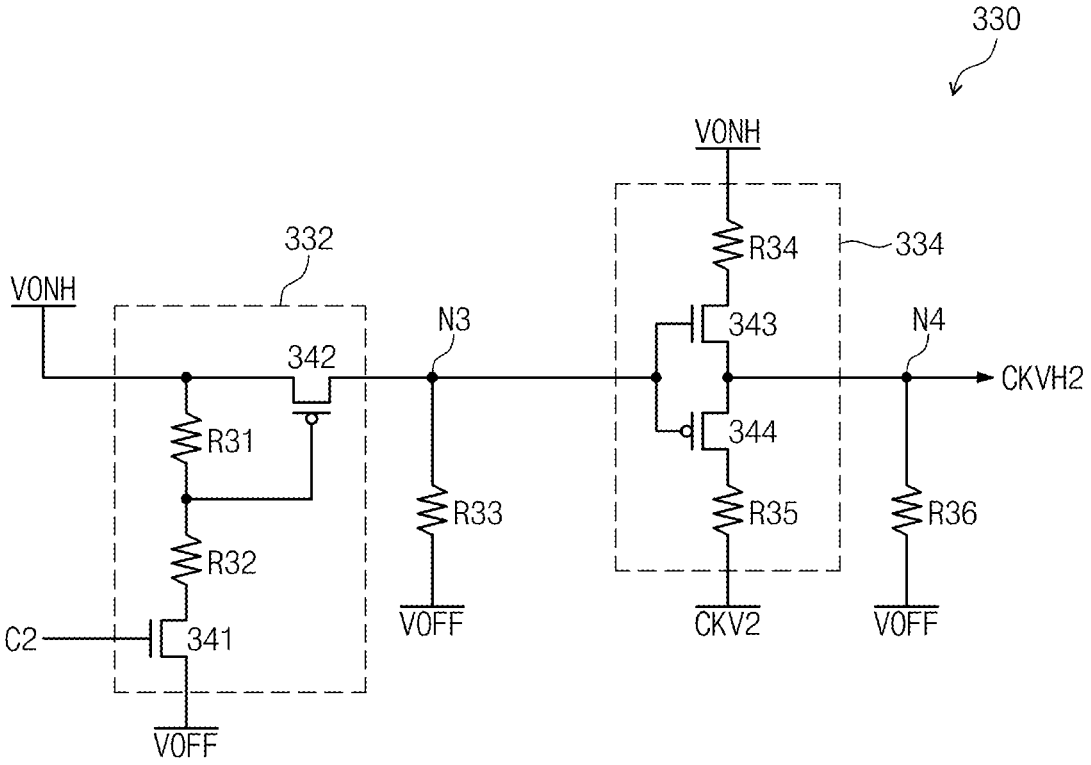
FIG. 10 is a circuit diagram schematically illustrating a second clock generator of FIG. 8 according to one or more embodiments of the invention.

FIG. 10 is a circuit diagram schematically illustrating the second clock generator 330 of FIG. 8 according to one or more embodiments of the invention.

Referring to FIG. 10, the second clock generator 330 may include a first switching unit 332, a second switching unit 334, and resistors R33 and R36.

The first switching unit 332 may include resistors R31 and R32 and transistors 341 and 342. The resistors R31 and R32 and the transistor 341 may be electrically connected in series between the second gate-on voltage VONH (also illustrated in FIGS. 8 and 9) and the gate-off voltage VOFF (also illustrated in FIGS. 8 and 9). The transistor 341 may be an NMOS transistor. A gate terminal of the transistor 341 may be connected to receive the second control signal C2 (also illustrated in FIG. 8) from the timing controller 120 of FIG. 1. The transistor 342 may be electrically connected between the second gate-on voltage VONH and a third node N3 that is electrically connected between the first switching unit 332 and the second switching unit 334. The transistor 342 have a gate terminal electrically connected to a connection node electrically connected between the resistors R31 and R32. The transistor 342 may be a PMOS transistor. The resistor R33 may be connected between the third node N3 and the gate-off voltage VOFF and may be subjected to the gate-off voltage VOFF.

The second switching unit 334 may include resistors R34 and R35 and transistors 343 and 344. The resistor R34, the transistors 343 and 344, and the resistor R35 may be electrically connected in series between the second gate-on voltage VONH and the second gate clock signal CKV2 (also illustrated in FIG. 8). The transistor 343 may be an NMOS transistor, and the transistor 344 may be a PMOS transistor. Gate terminals of the transistors 343 and 344 may be electrically connected to the third node N3. The resistor R36 may be electrically connected between a fourth node N4 (which is equivalent to or is connected to a connection node that is electrically connected between the transistors 343 and 344) and the gate-off voltage VOFF and may be subjected to the gate-off voltage VOFF. A signal provided through and/or provided from the fourth node N4 may be the second boosted gate-on voltage CKVH2 (also illustrated in FIG. 8).

When the second control signal C2 is at a low level, the transistors 341 and 342 in the first switching unit 332 may be turned off. As a result, a signal provided from the third node N3 to the second switching unit 334 may have the gate-off voltage VOFF.

When a signal provided from the third node N3 to the second switching unit 314 has the gate-off voltage VOFF, the transistor 343 in the second switching unit 334 may be turned off, while the transistor 344 in the second switching unit 334 may be turned on. As a result, the second boosted gate clock signal CKVH2 (also illustrated in FIG. 8) provided from the fourth node N4 may be equal to the second gate clock signal CKV2.

When the second control signal C2 is at a high level, the transistors 341 and 342 in the first switching unit 332 may be turned on. Thus, a signal provided from the third node N3 to the second switching unit 334 may have the second gate-on voltage VONH.

When a signal provided from the third node N3 to the second switching unit 334 has the second gate-on voltage VONH, the transistor 343 in the second switching unit 334 may be turned on, and the transistor 344 in the second switching unit 334 may be turned off. As a result, the second boosted gate clock signal CKVH2 provided from the fourth node N4 may be equal to the second gate-on voltage VONH.

Figure 11:
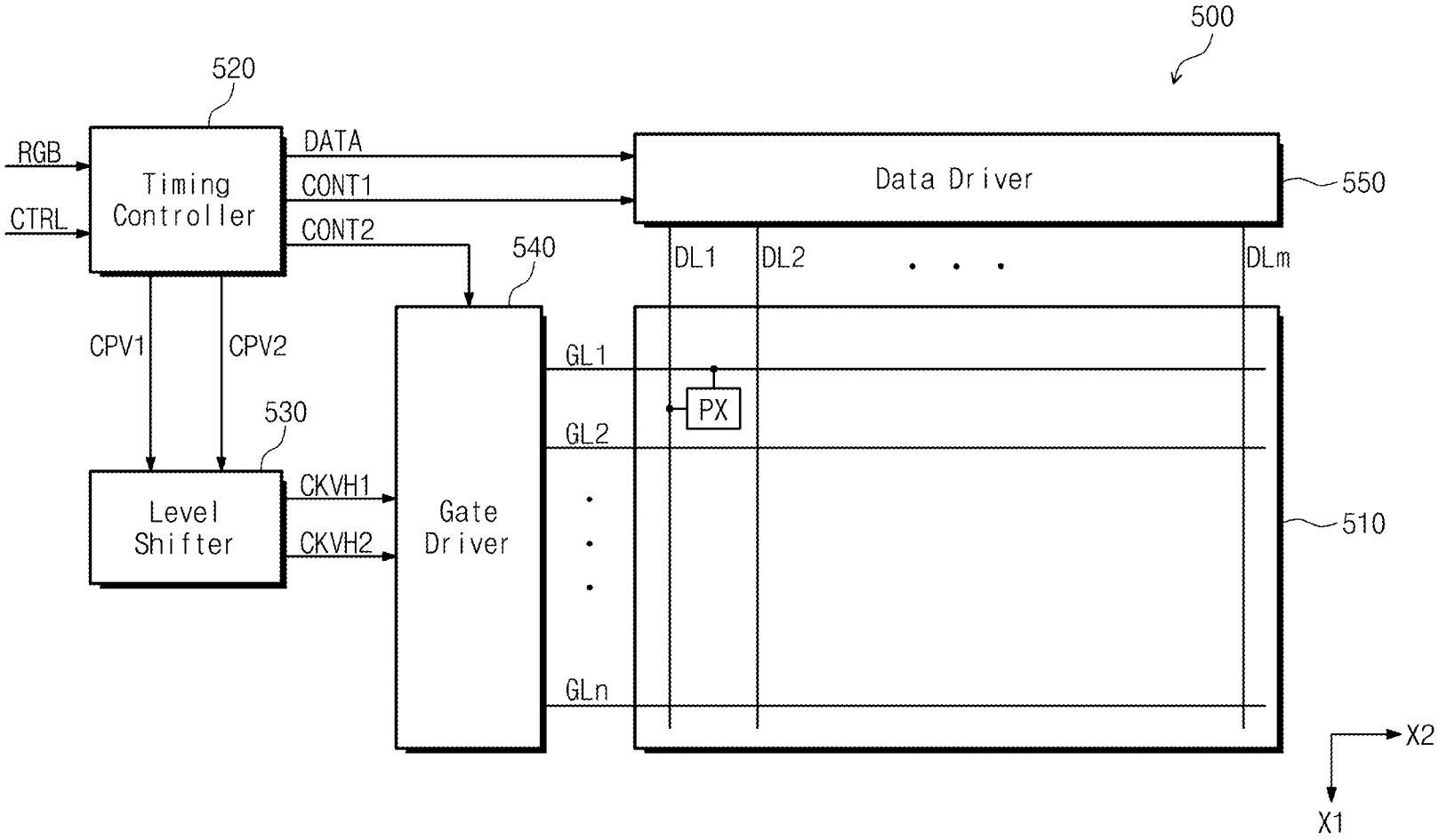
FIG. 11 is a block diagram schematically illustrating a display device according to one or more embodiments of the invention.

FIG. 11 is a block diagram schematically illustrating a display device 500 according to one or more embodiments of the invention. The display device 500 may include a display panel 510, a timing controller 520, a level shifter element 530, a gate driver 540, and a data driver 550.

Some features of the display device 500 of FIG. 11 may be analogous to some features of the display device 100 of FIG. 1; therefore, some duplicated description may be omitted.

In the display device 500, the timing controller 520 may output a first gate pulse signal CPV1 and a second gate pulse signal CPV2 to a level shifter element 530. The level shifter element 530 may output a first boosted gate clock signal CKVH1 and a second boosted gate clock signal CKVH2 in response to the gate pulse signals CPV1 and CPV2 received from the timing controller 520.

Figure 12:
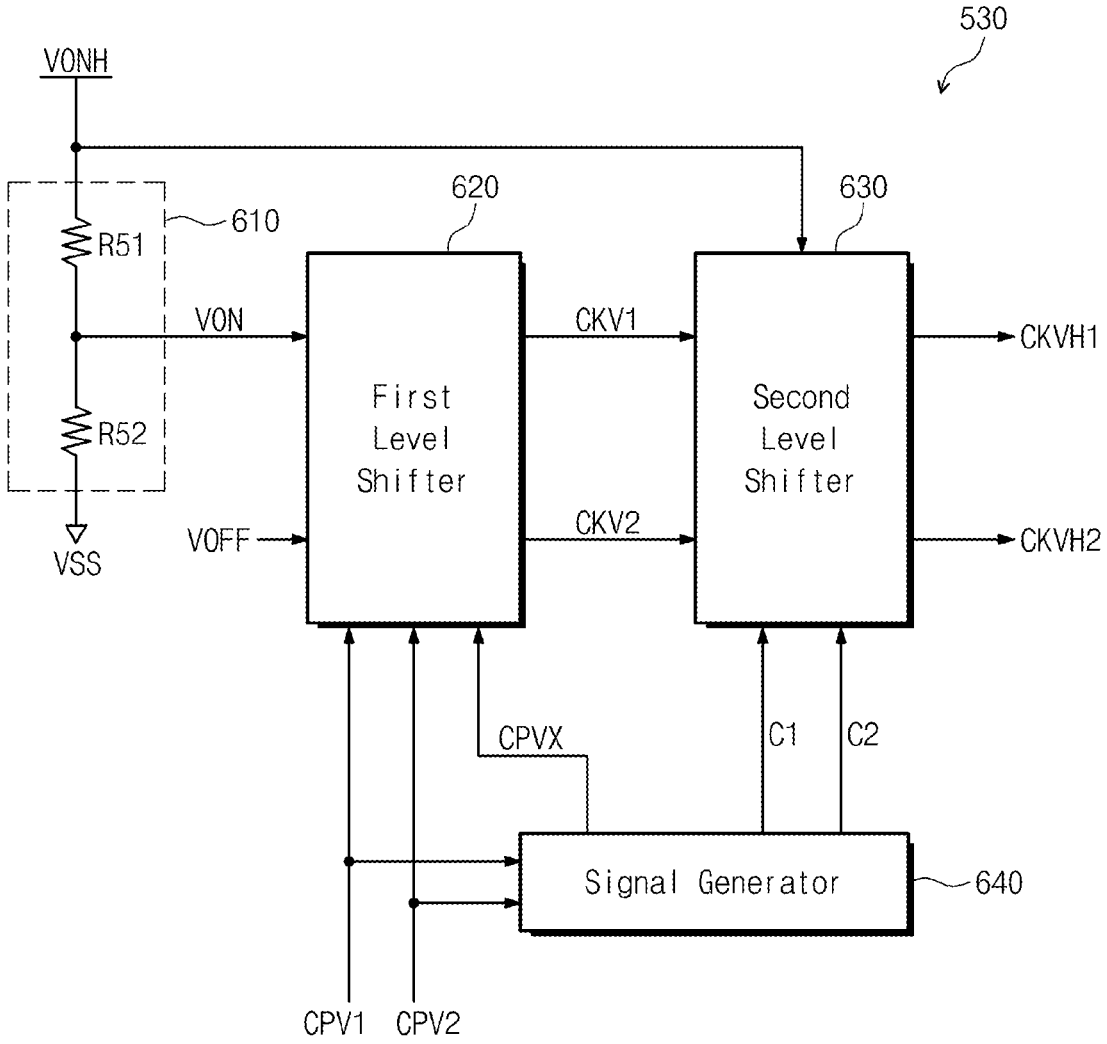
FIG. 12 is a block diagram schematically illustrating a level shifter of FIG. 11 according to one or more embodiments of the invention.

FIG. 12 is a block diagram schematically illustrating the level shifter element 530 of FIG. 11 according to one or more embodiments of the invention.

Referring to FIG. 12, the level shifter element 530 may include a voltage divider 610, a first level shifter 620, a second level shifter 630, and a control signal generator 640. The voltage divider 610 may be configured to output a first gate-on voltage VON and may include resistors R51 and R52 that are electrically connected in series between a second gate-on voltage VONH and a ground voltage VSS. A voltage on a tap of the voltage divider 610 (which may be a node electrically connected between the resistors R51 and R52) may be output as the first gate-on voltage VON. Thus, the second gate-on voltage VONH may be higher in level than the first gate-on voltage VON.

The first level shifter 620 may receive the first gate-on voltage VON and a gate-off voltage VOFF, and may output a first gate clock signal CKV1 and a second gate clock signal CKV2 in response to the gate pulse signals CPV1 and CPV2 received from the timing controller 520 of FIG. 11.

The control signal generator 640 may generate a charge share signal CPVX, a first control signal C1, and a second control signal C2 in response to the gate pulse signals CPV1 and CPV2 received from the timing controller 520.

The second level shifter 630 may output one of the second gate-on voltage VONH and the first gate clock signal CKV1 the a first boosted gate clock signal CKVH1 in response to the first control signal C1 received from the control signal generator 640. The second level shifter 630 may output one of the second gate-on voltage VONH and the second gate clock signal CKV2 as the second boosted gate clock signal CKVH2 in response to the second control signal C2 received from the control signal generator 640.

The signals C1, C2, CPVX, CPV1, CPV2, CKVH1, and CKVH2 discussed with reference to FIGS. 11 and 12 may have the waveforms discussed with reference to FIG. 6.

While the invention has been described with reference to exemplary embodiments, it will be apparent to those skilled in the art that various changes and modifications may be made without departing from the spirit and scope of the present invention. Therefore, it should be understood that the above embodiments are not limiting, but illustrative.

What is claimed is:

1. A display device, comprising:

a display panel including a plurality of pixels connected to a plurality of data lines and a plurality of gate lines;

a gate driver configured to provide gate signals through the plurality of gate lines to the plurality of pixels;

a data driver configured to provide data signals through the plurality of data lines to the plurality of pixels;

a level shifter element configured to provide a first boosted gate clock signal to the gate driver; and a timing controller configured to provide a plurality of control signals for controlling the level shifter element, the gate driver, and the data driver, wherein the level shifter element comprises:

a first level shifter configured to provide one of a first gate-on voltage and a gate-off voltage as a first gate clock signal in response to a gate pulse signal received from the timing controller; and a second level shifter configured to receive the first gate clock signal, configured to provide the first boosted gate clock signal based on the first gate clock signal, and configured to provide one of a second gate-on voltage and the first gate clock signal as the first boosted gate clock signal in response to a first control signal received from the timing controller, wherein the second gate-on voltage is higher than the first gate-on voltage, and wherein the gate driver is configured to provide one or more of the gate signals in response to the first boosted gate clock signal.

2. The display device of claim 1, wherein the first level shifter comprises:

a first switching circuit configured to output one of the first gate-on voltage and the gate off voltage as the first gate clock signal in response to the gate pulse signal.

3. The display device of claim 2, wherein the level shifter element is further configured to provide a second boosted gate clock signal to the gate driver, and wherein the first level shifter further comprises a second switching circuit configured to output one of the first gate-on voltage and the gate off voltage as a second gate clock signal in response to the gate pulse signal.

4. The display device of claim 3, wherein the second level shifter is configured to output one of the second gate-on voltage and the second gate clock signal as the second boosted gate clock signal in response to a second control signal received from the timing controller.

5. The display device of claim 1, wherein the second level shifter is configured to output the first boosted gate pulse signal, the first boosted gate pulse signal including a first portion and a second portion, the first portion having a rising edge that occurs in response to the first gate clock signal, the second portion having a rising edge that occurs in response to the first control signal, a magnitude of the first portion being equal to the first gate-on voltage, a magnitude of the second portion being equal to the second gate-on voltage.

6. The display device of claim 1, wherein the second level shifter comprises:

a first clock generator configured to periodically and alternately output the first gate clock signal and the second gate-on voltage as the first boosted gate clock signal in response to the first control signal.

7. The display device of claim 6, wherein the second level shifter further comprises:

a second clock generator configured to periodically and alternately output a second gate clock signal and the second gate-on voltage as a second boosted gate clock signal in turn in response to a second control signal received from the timing controller.

8. The display device of claim 6, wherein the first clock generator comprises:

a first switching unit configured to output one of the gate-off voltage and the second gate-on voltage to a first node in response to the first control signal;

a first resistor electrically connected to the first node and subjected to the gate-off voltage;

a second switching unit configured to output one of the second gate-on voltage and the first gate clock signal to a second node as the first boosted gate clock signal in response to a signal provided from the first node; and a second resistor electrically connected to the second node and subjected to the gate-off voltage.

9. The display device of claim 8, wherein the first switching unit comprises:

a third resistor subjected to the second gate-on voltage;

a fourth resistor electrically connected to the third resistor at a connection point;

a first transistor electrically connected to the fourth resistor, subjected to the gate-off voltage, and having a gate terminal configured to receive the first control signal; and a second transistor subjected to the second gate-on voltage, electrically connected to the first node, and having a gate terminal electrically connected to the connection point.

10. The display device of claim 9, wherein the first transistor includes an n-type semiconductor, and wherein the second transistor includes a p-type semiconductor.

11. The display device of claim 8, wherein the second switching unit comprises:

a first transistor subjected to the second gate-on voltage, electrically connected to the second node, and having a gate terminal electrically connected to the first node; and a second transistor electrically connected to the second node, configured to receive the first gate clock signal, and having a gate terminal electrically connected to the first node.

12. The display device of claim 11, wherein the first transistor includes an n-type semiconductor, and wherein the second transistor includes a p-type semiconductor.

13. The display device of claim 11, wherein the timing controller is configured to provide the gate pulse signal at a first level for a time period, wherein the time period includes a first portion and a second portion, and wherein the timing controller is configured to provide the first control signal at the first level for the second portion.

14. The display device of claim 13, wherein the second portion follows the first portion.

* * * * *